US008997939B2

(12) United States Patent
Acquaviva

(10) Patent No.: US 8,997,939 B2
(45) Date of Patent: Apr. 7, 2015

(54) CONTROL SYSTEM FOR A HYDRAULIC ELEVATOR, WHICH INCLUDES A SPEED REGULATOR FOR CONTROLLING THE SPEED OF DISPLACEMENT OF THE ELEVATOR CAR

(75) Inventor: Sebastiano Acquaviva, Pino Torinese (IT)

(73) Assignee: Brea Impianti S.U.R.L., Martina Franca (IT)

( * ) Notice: Subject to any disclaimer, the term of this patent is extended or adjusted under 35 U.S.C. 154(b) by 765 days.

(21) Appl. No.: 13/266,394

(22) PCT Filed: Apr. 28, 2010

(86) PCT No.: PCT/IB2010/051844

§ 371 (c)(1),
(2), (4) Date: Oct. 26, 2011

(87) PCT Pub. No.: WO2010/125525

PCT Pub. Date: Nov. 4, 2010

(65) Prior Publication Data

US 2012/0043164 A1 Feb. 23, 2012

(30) Foreign Application Priority Data

Apr. 29, 2009 (IT) ..... TO2009A0339

(51) Int. Cl.
*B66B 1/28* (2006.01)
*B66B 1/24* (2006.01)

(52) U.S. Cl.
CPC ..... *B66B 1/24* (2013.01)

(58) Field of Classification Search
USPC ..... 187/247, 285, 286, 293, 295, 296, 297, 187/391–393
See application file for complete search history.

(56) References Cited

U.S. PATENT DOCUMENTS 4,593,792 A 6/1986 Yamamoto
5,131,507 A * 7/1992 Watanabe ..... 187/285

(Continued)

FOREIGN PATENT DOCUMENTS

GB 2 243 927 A 11/1991
JP 3-098965 A 4/1991
JP 5-024750 A 2/1993

OTHER PUBLICATIONS

International Search Report for PCT/IB2010/051844 dated Aug. 19, 2010.

*Primary Examiner* — Anthony Salata
(74) *Attorney, Agent, or Firm* — Sughrue Mion, PLLC

(57) ABSTRACT

A control system for a hydraulic elevator. The system (10) controls an elevator (1) which includes an elevator cylinder (5) with a piston (5*a*) coupled to a car (2), a pump (4) having an outlet coupled to the elevator cylinder (5), and an electric motor (3) coupled to the pump (4). A speed regulator (11) for controlling the speed of the car (2) is driven in predetermined modes, such that the pump (4) rotates at predefined speed. The speed regulator (11) is driven such that the motor (3) of the pump (4) is supplied with a voltage having a frequency (f) the value of which corresponds to a predefined speed value (ω), increased by an amount ($cf_t$; $f_{ts}$, $f_{tD}$) which is a predetermined function of the working pressure ($P_1$) of the pump (4). This balances the effect of the leakage of operating hydraulic fluid in the pump (4).

10 Claims, 1 Drawing Sheet

(56) References Cited

U.S. PATENT DOCUMENTS

| | | | | |
|---|---|---|---|---|
| 5,243,154 | A * | 9/1993 | Tomisawa et al. | 187/286 |
| 5,635,689 | A * | 6/1997 | Shepard et al. | 187/292 |
| 5,959,266 | A * | 9/1999 | Uchiumi | 187/292 |
| 6,510,923 | B1 * | 1/2003 | Veletovac et al. | 187/285 |
| 7,235,948 | B2 * | 6/2007 | Nakakita et al. | 318/801 |
| 7,485,979 | B1 * | 2/2009 | Staalesen | 290/44 |
| 2003/0173159 | A1 * | 9/2003 | Moser | 187/285 |
| 2004/0074702 | A1 * | 4/2004 | Moser et al. | 187/275 |

* cited by examiner

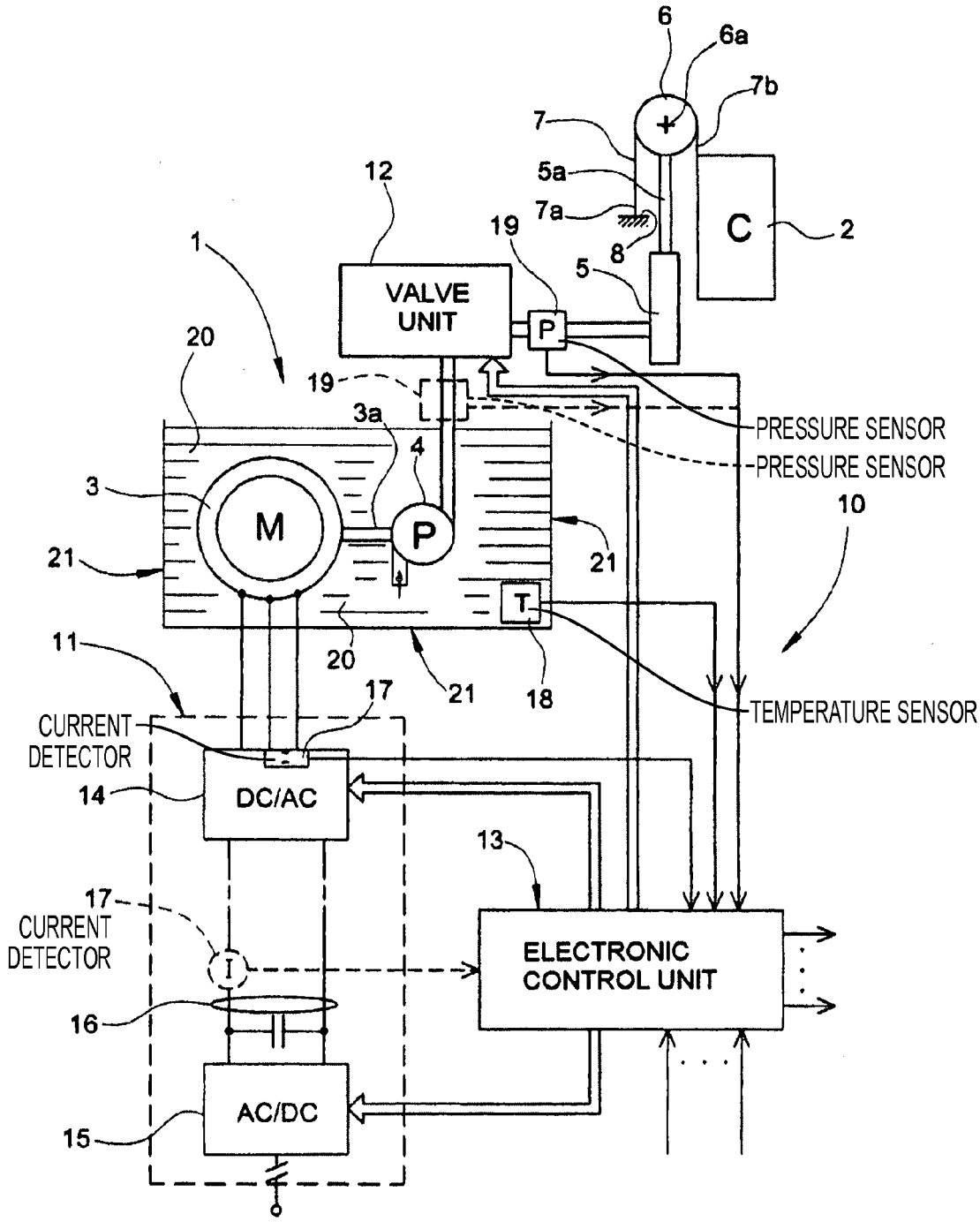
6
6a
7b
7
5a
7a
8
5
C
2
12
19
1
VALVE UNIT
P
20
19
L
3a
4
PRESSURE SENSOR
PRESSURE SENSOR
3
M
P
10
21
21
T
11
20
21
18
17
TEMPERATURE SENSOR
CURRENT DETECTOR
14
DC/AC
13
17
CURRENT DETECTOR
I
ELECTRONIC CONTROL UNIT
16
AC/DC
15

CONTROL SYSTEM FOR A HYDRAULIC ELEVATOR, WHICH INCLUDES A SPEED REGULATOR FOR CONTROLLING THE SPEED OF DISPLACEMENT OF THE ELEVATOR CAR

CROSS REFERENCE TO RELATED APPLICATIONS

This application is a National Stage of International Application No. PCT/IB2010/051844 filed on Apr. 28, 2010, which claims priority from Italian Patent Application No. TO2009A000339, filed on Apr. 29, 2009, the contents of all of which are incorporated herein by reference in their entirety.

The present invention relates to a control system for elevator equipment.

More specifically the invention relates to a control system for a hydraulic elevator apparatus which comprises

- an elevator cylinder with a piston coupled to a car or the like,
- a pump having the outlet coupled to the elevator cylinder, and
- an electric motor coupled to the pump;
- the control system comprising a speed regulator associated with the motor for controlling the speed of displacement of the car, and being predisposed for driving said speed regulator in predetermined modes, such that the pump rotates at a speed having a predefined value.

This type of elevator apparatus comprises a positive-displacement pump which is usually of screw type.

Positive-displacement screw pumps exhibit a small leakage of the operating hydraulic fluid (oil with additives), which, compared with the nominal flow rate of such a pump, is usually negligible and has little impact on the cruise speed of the elevator car.

In traditional systems, the positive-displacement pump always works at maximum speed, and the speed of the elevator car is controlled by a valve unit. Because the pump in these systems is always working at maximum speed, the effect of the oil leak in the pump is negligible and does not cause any problems when the car is coming into position at a floor. However, these traditional systems have the drawback of low operational efficiency. In addition, with these systems the speed of the car is reduced by energy dissipation, resulting in excessive heating of the operating hydraulic fluid. Furthermore, when the car is descending, almost all of its potential energy is dissipated in the form of heat in the operating fluid, further aggravating the problems due to the temperature of this fluid and sometimes requiring the use of a heat exchanger to cool it down, which is intrinsically costly and alters the overall energy balance.

To improve the operational efficiency of an elevator apparatus of this sort, when both ascending and descending, it is known practice to control the speed of the car by controlling the speed of rotation of the motor connected to the pump, e.g. by means of an inverter. In this way the speed of the car is controlled by varying the speed of rotation of the pump, which, being of positive-displacement type, therefore varies its capacity, with the advantage that the electricity supply is thus required to deliver only enough electrical power to move the car itself.

With these systems there is however the disadvantage that at low speeds of rotation of the pump, especially when a car is moving into position at a floor, the hydraulic fluid leak in the pump significantly affects the speed of the car. What happens is that the speed $V_c$ of the car is given by the following equation:

$$V_c = K\frac{Q_o}{S_p}$$

where K is a constant (the transmission ratio of the apparatus), $Q_0$ is the pump capacity and $S_p$ is the transverse cross-sectional area of the piston of the elevator cylinder.

The capacity $Q_0$ of the pump is related to the velocity ω of the motor by the equation:

$$Q_o = k\omega - cQ_t$$

where k is a coefficient of proportionality, typical of the pump, $Q_t$ is the leakage flow rate of the pump, and c is equal to 1 when ascending, and −1 when descending.

From the equation given above it is immediately clear that when the speed ω of the motor, and of the pump, is reduced, the pump's capacity $Q_0$ is reduced in proportion, but the term $Q_t$ becomes much greater as a percentage.

The significance of the leakage flow rate of the pump at low speeds can interfere with the control of the position of the car. Thus, when a car arrives at a particular floor it is positioned at a speed of approximately 1/6-1/10 of the cruise speed. Under these conditions the leakage flow rate $Q_t$ is of the same order of magnitude as the capacity $Q_0$, and there is thus a high risk that the car will be positioned extremely slowly or even be unable to be positioned.

It is an object of the present invention to provide a control system for a hydraulic elevator apparatus which enables the recovery of or compensation for the leakage of operating hydraulic fluid in the pump, particularly in the car positioning phases.

This and other objects are achieved by the invention with a control system of the type specified above, characterized by being predisposed for driving the speed regulating system such that the motor of the pump is supplied with a voltage having a frequency the value of which corresponds to the aforesaid predefined speed value, increased by an amount which is a predetermined function of the working pressure of the pump, such as to balance at least in part the effect of the leakage of hydraulic fluid in the pump.

In one embodiment, said amount or increase of the supply frequency is determined in accordance with a predefined function of the magnitude of the electric current flowing through the winding or windings of the motor, advantageously detectable within said speed regulator.

In another embodiment, the aforesaid amount or increase of the supply frequency is determined in accordance with a predefined function of the working pressure of the pump, detected by means of an electrical pressure sensor.

Advantageously, the aforesaid amount or increase of the supply frequency can also be determined as a function of the instantaneous temperature of the operating hydraulic fluid, which may be detected for example by means of a suitable electrical sensor.

Other features and advantages of the invention will be made clear by the following detailed description, given purely by way of non-restrictive examples, with reference to the appended drawing (FIG. 1), which is a diagram of a hydraulic elevator apparatus to which a control system according to the present invention is fitted.

The control system according to the invention is applicable for example to the hydraulic elevator equipment 1 for which a general diagram is shown in FIG. 1.

This elevator equipment 1 comprises a car (or the like) 2 which is movable operationally between a plurality of levels or floors.

The elevator equipment 1 is able to be driven by an electric motor 3, such as an induction-type three-phase alternating-current motor with a shaft 3*a* turning the hydraulic pump 4. The motor 3 and the pump 4 are usually immersed in the operating hydraulic fluid 20 contained in a tank or reservoir 21.

The pump 4 is a positive-displacement pump such as a screw pump, and its outlet supplies a flow of operating hydraulic fluid at pressure to an elevating cylinder 5, the piston rod 5*a* of which carries at its top end a sheave 6. The sheave 6 is rotatable about a horizontal axis 6*a*, and a cable 7 passes around it with one end 7*a* attached to a stationary point 8 and the other end 7*b* connected to the car.

The control system according to the present invention is also applicable to hydraulic elevator apparatus differing from that described above.

A control system bearing the general reference 10 is also fitted to the hydraulic elevator apparatus 1.

This system comprises a speed regulator unit 11 connected to the motor 3 to control the speed of displacement of the car 2, an electrohydraulic valve unit 12 connected to the pump 4 and to the elevating cylinder 5, and an electronic control unit 13 for driving the speed regulator 11 and the electrohydraulic unit 12 (and other devices not shown) according to set modes.

In the illustrated embodiment shown by way of example the speed regulator unit 11 comprises an inverter 14 which has its DC side connected to the output of a rectifier device (AC/DC converter) 15 and its AC side connected to the supply terminals of the electric motor 3.

The rectifier device 15, which may be single-phase or multiphase and reversible or not reversible, has its AC side connected to an AC supply voltage source such as the AC electricity distribution mains.

The DC side of the rectifier device 15 is connected to the input of the inverter 14 by a DC line or bus 16. A bank of voltage stabilizing capacitors is advantageously connected in parallel to this line or bus.

The speed regulating unit 11 is equipped with at least one current detector 17, for example within the inverter 14, and is connected to the electronic control unit 13.

In a variant, which will be discussed in more detail later, it is possible to replace such a detector with a current sensor connected to a conductor of the line or bus 16, such as the sensor shown in broken lines, and also numbered 17, in FIG. 1.

The unit 13 is also connected to control inputs on the converters 14 and 15, as well as to control inputs on the electrohydraulic valve unit 12.

The electronic control unit 13 is designed to control the speed regulator 11 according to set modes.

The control exerted by the electronic unit 13, particularly when the car 2 is being positioned at a floor, is based on the following considerations.

The rotational speed of the motor 3, and hence of the pump 4, is a function of the frequency f of its supply voltage or voltages, and is controlled by the regulator 11: compensation for the effects of the leakage of operating hydraulic fluid in the pump is achieved by increasing the frequency f by a quantity $cf_t$ in accordance with the following equation:

$$f_M = f + cf_t = f + cf_o\left(\frac{P_1}{P_o}\right)^{\alpha}\left(\frac{T_1}{T_o}\right)^{\beta} \tag{1}$$

where $f_M$ is the supply frequency of the motor 3 corrected for the purpose of compensating for the leakage in the pump, f is the supply frequency of the motor 3 in the absence of leakage, $f_t$ is the frequency component for compensating for the leakage effect in the pump 4, c is a 1 for ascending, and a −1 for descending, $f_0$ is the increase in the supply frequency due to the oil leakage in the pump at a reference pressure $P_0$ and at a reference temperature $T_0$, $P_1$ is the working pressure of the pump 4, $T_1$ is the working temperature of the operating hydraulic fluid, and α, β are experimentally determined exponents characteristic of the pump.

The frequency $f_0$ is determined experimentally (once) using the equation:

$$f_o = f\,\frac{V_{PD} - V_{PS}}{V_{PD} + V_{PS}}\Big|_{T_o,P_o}$$

where f is the supply frequency of the inverter 14;

$V_{PD}$ is the positioning speed of the car to the floor during descent, in the absence of leakage compensation, and $V_{PS}$ is the speed of positioning of the car to the floor on ascent, in the absence of leakage compensation.

The above applies if the effects of the leakage in the pump 4 can be assumed to be approximately the same when ascending and descending. If this is not the case, however, the following procedure is followed:

the following are calculated:

$$f_{os} = \frac{V_P - V_{PS}}{V_{PS}}\Big|_{T_o,P_o}, \text{ and}$$

$$f_{oD} = f\,\frac{V_{PD} - V_P}{V_{PD}}\Big|_{T_o,P_o}$$

where $V_P$ is the theoretical (desired) speed of positioning of the car; and instead of equation (1) above, the following equations are used:

$$f_{MS} = f + f_{ts} = f + f_{os}\left(\frac{P_1}{P_o}\right)^{\alpha}\left(\frac{T_1}{T_o}\right)^{\beta} \tag{1a}$$

$$f_{MD} = f - f_{tD} = f - f_{oD}\left(\frac{P_1}{P_o}\right)^{\alpha}\left(\frac{T_1}{T_o}\right)^{\beta} \tag{1b}$$

and when ascending or descending, the supply frequencies $f_{MS}$ and $f_{MD}$, respectively, are applied to the motor 3.

Referring to equations (1), (1a) and (1b), the instantaneous temperature $T_1$ of the operating hydraulic fluid can be determined easily, and cheaply, by a temperature sensor 18 connected to the electronic control unit 13.

The reference temperature $T_0$ can be measured by this sensor, with the car 2 empty, and with the operating hydraulic fluid cold (ambient reference temperature).

The working pressure $P_1$ can also be detected very simply, but at a relatively high cost, by an electrical pressure sensor 19 connected to the output or input of the electrohydraulic valve unit 12. The pressure $P_0$ can be determined when the car is empty.

Having acquired the reference values $T_0$ and $P_0$, and the instantaneous values $P_1$ and $T_1$, the electronic control unit 13 is now able to determine the increase in the supply frequency (i.e. speed of the motor) which according to equation (1) or equations (1a) or (1b) given above, will compensate for the effect of the leakage of operating fluid in the pump 4.

As an alternative to the above, the working pressure $P_1$ of the pump 4 can be determined more economically and efficiently in the following manner.

It has been found that the working pressure $P_1$ of the pump 4 is approximately proportional to the resistive torque at the shaft 3*a* of the motor 3, which in turn is proportional to the electric current I in the windings of this motor. It is therefore possible to express the following equation:

$$P_1=k_1I^{\gamma} \quad (2)$$

where $k_1$ is an experimentally determinable constant typical of the particular motor/pump unit, I is the current in the motor 3, and $\gamma$ is an exponent which may be determined experimentally on the basis of the particular motor used and the mode adopted for its control.

For a synchronous permanent-magnet electric motor (brushless motor) and for a field-oriented-controlled asynchronous electric motor (induction motor), $\gamma=1$, and $I=I_q$, where $I_q$ is the current in quadrature in the axis variables in the reference system of the rotating magnetic field.

For an open loop-supplied asynchronous electric motor, $\gamma=2$, and I is the modulus of the rotating vector which represents the current in the motor.

For other types of motors the values for $\gamma$ and I are determinable analytically or experimentally, but equation (2) above still applies to them.

In the variant described here, the compensation for the effect of oil leakage in the pump 4 as the load in the elevator car varies again essentially involves applying equation (1) or equations (1a), (1b): the electronic control unit 13 acquires a signal from the sensor 17 indicating the strength of the current in the motor 3, and adopts as its reference current $I_0$ the minimum value of the current detected in a predetermined number of journeys of the car 2. The unit 13 then calculates the frequency increase on the basis of equation (1), or of equations (1a), (1b), where the working pressure $P_1$ of the pump 4 is worked out from equation (2).

As already mentioned earlier, the detector detecting the current flowing in the winding or windings of the motor 3 can be replaced with a current sensor connected to one of the conductors of the line or bus 16, as shown in broken lines in the drawing.

In this case the detected current (the DC current in the bus 16) is proportional to the power put out by the motor 3 rather than to the torque which it develops. However, the unit 13 can be designed to still use this current information: the torque developed by the motor is proportional to the ratio of the strength I of the DC current in the bus 16 to the speed of rotation $\omega$ of this motor. Having acquired the current strength I, unit 13 can work out the torque developed by the motor because this unit knows the speed of rotation of the motor, which is related to the supply frequency by known functions which depend on the type of motor.

Clearly, without departing from the principle of the invention, the embodiments and details of construction may depart significantly from those described and illustrated purely by way of non-restrictive example, without thereby departing from the scope of the invention as defined in the appended claims.

The invention claimed is:

1. A control system (10) for a hydraulic elevator apparatus (1) which comprises an elevator cylinder (5) with a piston (5*a*) coupled to a car (2), a pump (4) having the outlet coupled to the elevator cylinder (5), and an electric motor (3) coupled to the pump (4);

the control system comprising a speed regulator (11) associated with the motor (3) for controlling the speed of displacement of the car (2), and being predisposed for driving the speed regulator (11) in predetermined modes, such that the pump (4) rotates at a speed having a predefined value (W);

wherein the control system (10) is predisposed for driving the speed regulator (11) such that the motor (3) of the pump (4) is supplied with a voltage having a frequency (f) the value of which corresponds to said predefined speed value ($\omega$), increased by an amount ($cf_t$; $f_{ts}$, $f_{tD}$) which is a predetermined function of the working pressure ($P_1$) of the pump (4), such as to balance at least in part the effect of the leakage of hydraulic fluid in the pump (4), and wherein said amount or increase (cft; fts, ftD) of the supply frequency is determined in accordance with a predefined function of the magnitude of the electric current (I) flowing through the motor (3).

2. A control system according to claim 1, wherein the magnitude of the electric current (I) flowing through the motor (3) is detected within said speed regulator (11).

3. A control system according to claim 1, wherein said amount or increase ($cf_t$; $f_{ts}$, $f_{tD}$) of the supply frequency is determined in accordance with a predefined function of the working pressure ($P_1$) of the pump (4), detected by means of an electrical pressure sensor (19).

4. A control system according to claim 1, wherein said amount or increase ($cf_t$; $f_{ts}$, $f_{tD}$) of the supply frequency is determined in accordance with a pre-defined function of the ratio of the instantaneous value (I) of the current through the motor (3) to a predefined reference current value ($I_0$).

5. A control system according to claim 4, wherein said reference current value ($I_0$) is defined as the minimum value of the current (I) flowing through the motor (3) in a predetermined number of runs of the car (2).

6. A control system according to claim 1, wherein said amount or increase ($cf_t$; $f_{ts}$, $f_{tD}$) of the supply frequency is determined also as a function of the temperature ($T_1$) of the operating hydraulic fluid.

7. A control system according to claim 6, wherein the temperature ($T_1$) of the operating hydraulic fluid is detected by means of an electrical temperature sensor (18).

8. A control system according to claim 6, wherein said speed amount or increase ($c\omega_t$) is determined according to a predetermined function of the ratio of the instantaneous temperature ($T_1$) of the operating hydraulic fluid to a predefined reference temperature ($T_0$).

9. A control system according to claim 8, wherein said reference temperature ($T_0$) is the temperature of the operating hydraulic fluid detected without any load in the car.

10. A control system according to claim 1, wherein the increase ($cf_t$; $f_{ts}$, $f_{tD}$) of the supply frequency is positive when the car is running upwards, and is negative when the car is running downwards; wherein the absolute values of said increase for the upward run and for the downward run can be different from one another.

* * * * *